US009252532B2

(12) United States Patent
Riedel et al.

(10) Patent No.: US 9,252,532 B2
(45) Date of Patent: Feb. 2, 2016

(54) DEVICE FOR ATTACHING AN AIRCRAFT CABIN MODULE

(75) Inventors: Christian Riedel, Bliedersdorf (DE); Michael Weidel, Giesen (DE)

(73) Assignee: Airbus Operations GmbH, Hamburg (DE)

( * ) Notice: Subject to any disclaimer, the term of this patent is extended or adjusted under 35 U.S.C. 154(b) by 0 days.

(21) Appl. No.: 12/836,282

(22) Filed: Jul. 14, 2010

(65) Prior Publication Data

US 2011/0034058 A1 Feb. 10, 2011

Related U.S. Application Data

(63) Continuation of application No. PCT/EP2009/050954, filed on Jan. 28, 2009.

(60) Provisional application No. 61/062,580, filed on Jan. 28, 2008.

(30) Foreign Application Priority Data

Jan. 28, 2008 (DE) ..... 10 2008 006 433

(51) Int. Cl.
*H01R 13/627* (2006.01)
*H01R 25/14* (2006.01)

(52) U.S. Cl.
CPC ..... *H01R 13/6275* (2013.01); *H01R 25/14* (2013.01)

(58) Field of Classification Search
USPC ..... 439/682, 924.1, 347, 348, 352–354, 439/289, 157, 142, 147, 148, 249
See application file for complete search history.

(56) References Cited

U.S. PATENT DOCUMENTS

| | | | | | |
|---|---|---|---|---|---|
| 3,566,336 | A | * | 2/1971 | Johnson et al. | 439/353 |
| 4,458,973 | A | * | 7/1984 | Hayes et al. | 439/347 |
| 4,572,602 | A | * | 2/1986 | Rupnik | 439/350 |
| 4,761,144 | A | * | 8/1988 | Hunt et al. | 439/545 |
| 5,104,243 | A | * | 4/1992 | Harding | 385/84 |
| 5,486,117 | A | * | 1/1996 | Chang | 439/357 |
| 5,575,690 | A | * | 11/1996 | Eaton | 439/717 |

(Continued)

FOREIGN PATENT DOCUMENTS

| | | |
|---|---|---|
| CN | 2652608 | 11/2004 |
| DE | 26 08 303 | 9/1976 |

(Continued)

OTHER PUBLICATIONS

International Search Report for PCT/EP/2009/050954 dated May 12, 2009.

(Continued)

*Primary Examiner* — Abdullah Riyami
*Assistant Examiner* — Harshad Patel
(74) *Attorney, Agent, or Firm* — Jenkins, Wilson, Taylor & Hunt, P.A.

(57) ABSTRACT

A device for attaching an aircraft cabin module, which device comprises a component with limbs for the releasable locking of a plug pin, fitted to the aircraft cabin module, and a plurality of electrical contacts. The component is configured in U shape as the rail component, the limbs thereof having locking points for the releasable locking of the plug pin fitted to the aircraft cabin module and the center portion thereof connecting the two limbs comprising the electrical contacts for the voltage supply and for the exchange of data with the aircraft cabin module.

7 Claims, 3 Drawing Sheets

(56) References Cited

U.S. PATENT DOCUMENTS

| | | | | |
|---|---|---|---|---|
| 6,123,575 | A * | 9/2000 | Huang et al. | 439/489 |
| 6,146,210 | A * | 11/2000 | Cha et al. | 439/680 |
| 6,244,889 | B1 * | 6/2001 | James | 439/352 |
| 6,280,227 | B1 * | 8/2001 | Terada et al. | 439/357 |
| 6,478,631 | B1 | 11/2002 | Dutton et al. | |
| 6,687,780 | B1 * | 2/2004 | Garlepp et al. | 710/305 |
| 6,945,666 | B2 * | 9/2005 | Woolfson | 362/183 |
| 7,037,133 | B2 * | 5/2006 | Matsuo | 439/606 |
| 7,060,910 | B2 * | 6/2006 | Wussow et al. | 174/138 G |
| 7,134,900 | B2 * | 11/2006 | Chung | 439/353 |
| 7,431,605 | B2 * | 10/2008 | Dieterle et al. | 439/358 |
| D602,442 | S * | 10/2009 | Allwood | D13/156 |
| 7,597,567 | B2 * | 10/2009 | Tanaka et al. | 439/135 |
| 7,758,388 | B2 * | 7/2010 | Xu et al. | 439/651 |
| 2003/0194885 | A1 * | 10/2003 | Iino | 439/74 |
| 2005/0211835 | A1 | 9/2005 | Henley et al. | |
| 2006/0134952 | A1 * | 6/2006 | Meister et al. | 439/148 |
| 2008/0153356 | A1 * | 6/2008 | Chazottes | 439/626 |
| 2009/0221154 | A1 | 9/2009 | Hartlef et al. | |

FOREIGN PATENT DOCUMENTS

| | | |
|---|---|---|
| DE | 34 16 143 | 11/1985 |
| DE | 102006012730 | 11/2007 |
| DE | 699 36 580 T2 | 4/2008 |
| RU | 2231185 | 6/2004 |

OTHER PUBLICATIONS

Chinese Office Action (English Translation) for Application No. 200980103879.X dated Jun. 5, 2012.

Russian Decision to Grant for Application No. 2010133887/07 dated Dec. 17, 2012.

Chinese Office Action for Application No. 200980103879.X dated Mar. 25, 2013.

* cited by examiner

DEVICE FOR ATTACHING AN AIRCRAFT CABIN MODULE

CROSS-REFERENCE TO RELATED APPLICATIONS

This application is a continuation of PCT/EP2009/050954 filed Jan. 28, 2009 and claims the benefit of U.S. Provisional Application No. 61/062,580 filed Jan. 28, 2008, and German Patent Application No. 10 2008 006 433.5 filed Jan. 28, 2008, the entire disclosures of which are herein incorporated by reference.

TECHNICAL BACKGROUND

The invention relates to a device for attaching an aircraft cabin module, which device also provides the voltage supply for the aircraft cabin module and allows an exchange of data between the aircraft cabin module and an aircraft cabin server.

DE 10 2006 012 730 B3 describes an attachment system for attaching a cabin equipment element to a supporting structure of an aircraft. A device for attaching an aircraft cabin module is provided, the device comprising a component with limbs for releasably locking a plug pin fitted to the aircraft cabin module and a plurality of electrical contacts.

DE 699 36 580 T2 describes an electrical connector with a two-part housing and a terminal. The electrical connection structure comprises two half-shells, each half-shell including at least two openings which lead from an interior of the half-shell to an outer surrounding of the half-shell. Each half-shell includes a recessed channel along an inner surface, a retaining clip being attached to the half-shell, which clip includes at least two concealed lugs which pass through the at least two openings. In this arrangement, the retaining clip is pressed in via a snap connection in order to rest against the inner surface of the half-shell. A main surface of the retaining clip rests on the surface of the recessed channel, and before the connection, the retaining clip is attached thereto in each half-shell by a minimum of three contact points, at least two of the contact points being snap connection fittings.

A large number of aircraft cabin modules are mounted in the cabin of an aircraft, in particular of a passenger aircraft. These aircraft cabin modules include, for example passenger supply units (PSU), emergency oxygen supply units for the decentralised supply of oxygen to the passengers in an emergency, cabin illumination units, air jet units, passenger audio units, for example loud speakers, or passenger video units, for example display monitors. Some of these aircraft cabin modules have to be fed with a direct voltage supply of, for example 28 volt DC, while others, for example the emergency oxygen supply units have to be fed with an alternating voltage of, for example 115 volt AC.

In conventional aircraft, the aircraft cabin modules are supplied with electrical energy via voltage supply lines which are laid separately from data lines used for exchanging data between the aircraft cabin modules and a central computer. In this respect, the aircraft cabin modules are attached by mechanical mountings fitted in a profiled component which is provided in a cabin supply channel. Due to the separate cabling of data lines and voltage supply lines, the assembly of the aircraft cabin modules inside the cabin of an aircraft is very complex.

Therefore, it is an object of the present invention to provide a device for attaching aircraft cabin modules, for which the assembly effort is minimised and which is robust in respect of vibrations and acceleration forces.

SUMMARY OF THE INVENTION

The invention provides a device, which comprises a component with limbs for the releasable locking of a plug pin, fitted to the aircraft cabin module and a plurality of electrical contacts, wherein the component is configured in U shape as the rail component, the limbs thereof having locking points for the releasable locking of the plug pin fitted to the aircraft cabin module and the centre portion thereof connecting the two limbs comprising the electrical contacts for the voltage supply and for the exchange of data with the aircraft cabin module, spring-loaded locking projections being fitted on the plug pin, which locking projections catch into the locking points configured as locking recesses for locking the plug pin, and the electrical contacts exerting a retaining function for moving the plug pin in a longitudinal direction of the rail component before the locking of the plug pin.

In an embodiment of the device, the electrical contacts are formed by contact grooves, in which contact pins of the plug pin fitted to the aircraft cabin module can be moved in a longitudinal direction of the rail component before the locking of the plug pin.

This provides a high degree of flexibility during assembly of the aircraft cabin module, since before the aircraft cabin module is locked, a fitter can move the aircraft cabin module in the longitudinal direction into a desired position. This is all the more helpful, since the local distribution or positioning of the aircraft cabin modules can vary greatly in an aircraft in accordance with the passengers' wishes. Furthermore, it is consequently easier to keep places free for possible equipment installed later on if the aircraft cabin is provided with a different seating or class layout, for example.

In a possible embodiment, the rail component consists of a stable, light and electrically insulating material, for example aluminium, CFRP and/or Teflon. The electrically insulating contacts are inserted into this electrically insulating material.

In an embodiment of the attachment device according to the invention, the electrical contacts can be covered with a protective cap to protect them against corrosion. The protective cap consists of a rubber lip, for example. In addition to affording protection against corrosion, these protective contacts also protect a fitter or passenger in the event of accidentally touching the electrically conductive contacts.

In an embodiment, the electrically conductive contacts have contact groups, for example one group of direct voltage contacts for applying a direct voltage, one group of alternating voltage contacts for applying an alternating voltage and one group of data contacts for exchanging data between the aircraft cabin modules and an aircraft cabin server.

In this respect, the data contacts preferably each have a predetermined characteristic impedance of, for example 100 ohm/meter.

In one possible embodiment of the attachment device, provided on the plug pins are spring-loaded locking projections which catch into locking recesses.

It is possible to absorb the acceleration forces at which locking actions can be first initiated during flight operation as a function of the strength of the spring fitted on the locking projection. In one possible embodiment of the attachment device according to the invention, this acceleration force amounts to a multiple of the gravitational acceleration force, for example 16 G.

BRIEF DESCRIPTION OF DRAWINGS

In the following, preferred embodiments of the attachment device according to the invention for attaching an aircraft cabin module are described with reference to the accompanying figures to illustrate features which are essential to the invention.

In the drawings.

DETAILED DESCRIPTION OF EMBODIMENTS

Figure 1:
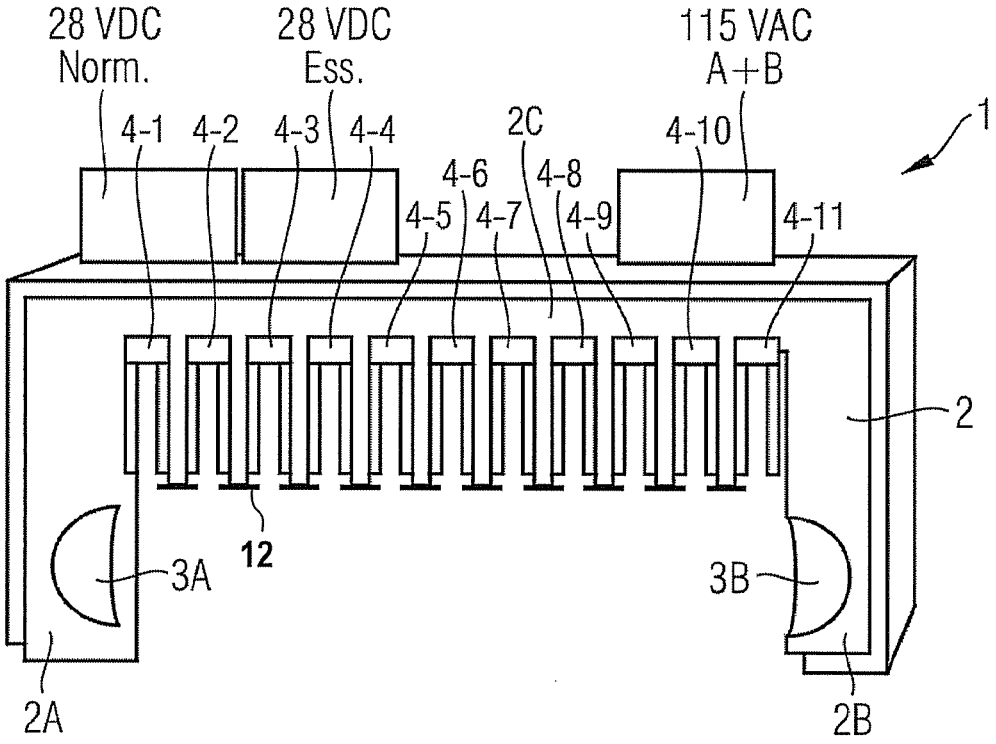
FIG. 1 shows an embodiment of an attachment device according to the invention.

As can be seen from FIG. 1, the attachment device 1 has a U-shaped rail component 2 which preferably consists of a light, stable and insulating material. The U-shaped rail element 2 has two opposing limbs 2A, 2B which are connected by a centrally positioned centre portion 2C. The two opposing limbs 2A, 2B are preferably formed integrally with the centre portion 2C. The rail component 2 forms a rail profile, the limbs of which form an angle, for example of approximately 90° to the centre portion 2C. The light, stable, insulating material of which the rail component 2 is made, is for example aluminium, CFRP or Teflon. The rail component 2 consists, for example of a thin, screening aluminium profile. As can be seen from FIG. 1, locking points 3A, 3B are each provided on the inner sides of the two opposing limbs 2A, 2B. The locking points 3A, 3B are preferably opposite one another and are formed, for example by hemispherical recesses. The centre portion 2C connecting the two limbs 2A, 2B has a plurality of electrical contacts 4-1 to 4-11 which, on the one hand are provided for the voltage supply of an aircraft cabin module and on the other hand allow data to be exchanged between an aircraft cabin module and an aircraft cabin server.

In the example shown in FIG. 1, the electrical contacts 4-1, 4-2 are provided for applying a direct voltage supply, for example a direct voltage supply of 28 volt DC for a normal voltage supply of the aircraft cabin module fitted to the attachment device 1.

Furthermore, the contacts 4-3, 4-4 are provided for an emergency direct voltage supply, for example amounting to 28 volt DC. Additionally, in the example shown in FIG. 1, the electrical contacts 4-5 to 4-8 form data contacts which are used for the exchange of data between the attached aircraft cabin module and an aircraft cabin server. In one possible embodiment, these data contacts have in each case a predetermined characteristic impedance of, for example 100 ohm/meter.

The electrical contacts 4-9 to 4-11 serve to apply an alternating voltage supply amounting to, for example 115 volt AC required for initiating an emergency oxygen supply for the aircraft cabin.

The attachment device 1 shown in FIG. 1 can be installed in a supply channel of an aircraft cabin. In one possible embodiment, to guard against the influence of moisture, the electrical contacts 4-*i* are each covered with an associated protective cap 12 to protect against corrosion. This protective cap 12 consists, for example of a rubber lip. The protective cap 12 also protects a fitter or passenger in the event of accidentally touching the contacts.

In a possible embodiment of the attachment device according to the invention, the electrical contacts 4-1 to 4-11, as shown in FIG. 1, are configured as contact grooves. Contact pins of a plug pin fitted to the aircraft cabin module can be moved in these contact grooves in the longitudinal direction of the rail component before the locking of the plug pin. This provides a great flexibility during assembly of the aircraft cabin modules inside the passenger cabin. Furthermore, the assembly of the aircraft cabin module is made a great deal easier for the fitter. In a possible embodiment, the electrical contacts 4-1 to 4-11 shown in FIG. 1 are not only used for electrical contacting, but they also exert a supporting function. Consequently, the aircraft cabin modules are securely fitted to the attachment device 1 even in the event of vibrations. Furthermore, it is easier for the fitter to move the aircraft cabin modules in the longitudinal direction before the final locking procedure, without having to exert a supporting force.

Figure 2:
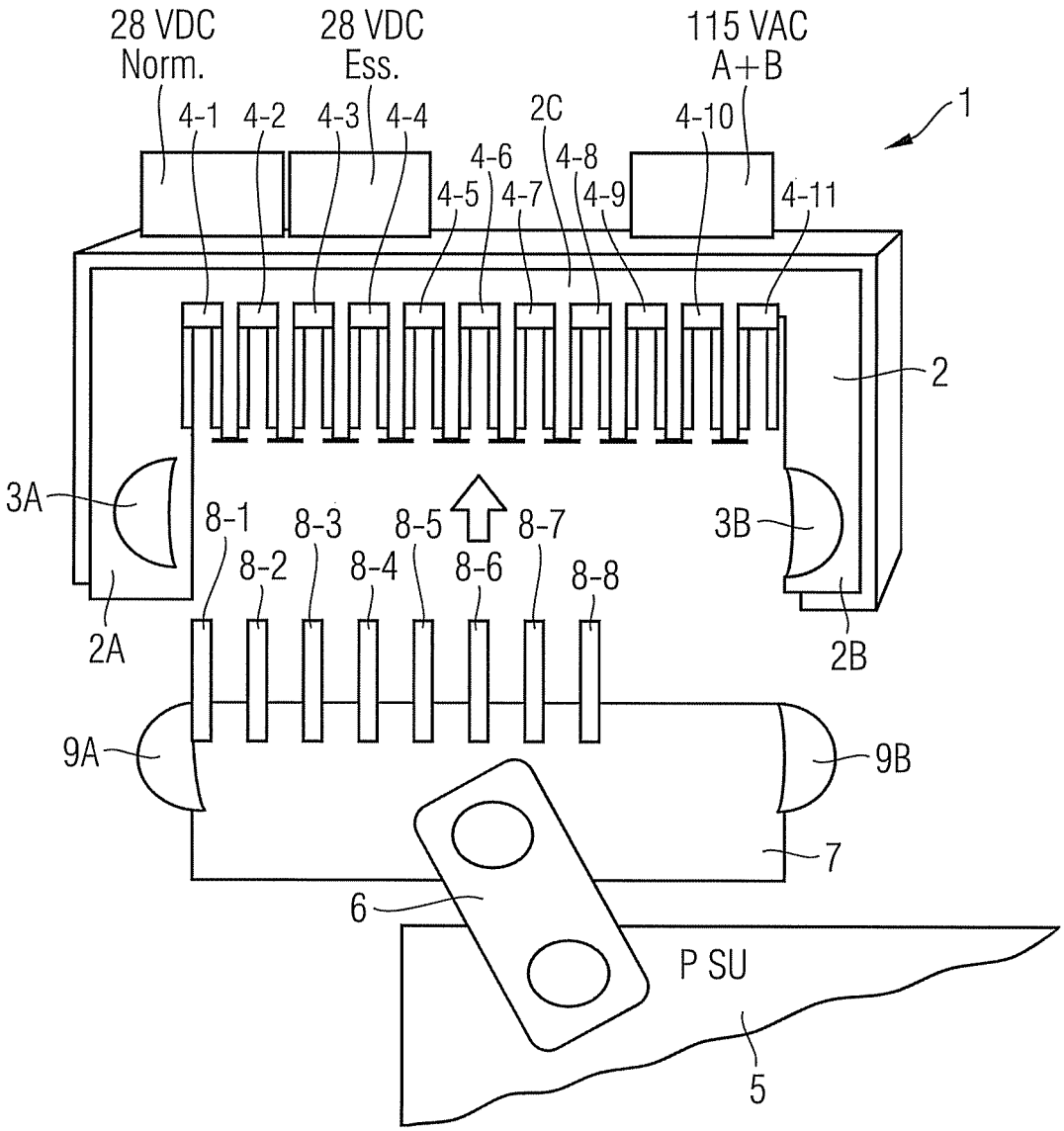
FIG. 2 shows the fitting of a passenger supply unit PSU to the embodiment, shown in FIG. 1, of the attachment device according to the invention.

FIG. 2 shows the mounting of a passenger supply unit 5 on the attachment device 1, as shown in FIG. 1. In a possible embodiment, the passenger supply unit 5 has a plug pin 7 which is attached via a joint 6 and has contact pins 8-1 to 8-8. The spacing between the contact pins 8-*i* corresponds to the spacing of the electrical contacts 4-*i* inside the rail component 2. In addition, the height of the projecting contact pins 8-*i* substantially corresponds to the depth of the electrical contacts 4-*i* inside the rail component 2. Since the passenger service unit 5 does not require an alternating voltage supply, the plug pin 7 of the passenger supply unit 5 does not have any contact pins for the alternating voltage supply contacts 4-9, 4-10, 4-11. In a possible embodiment, the electrical contacts 4-*i* and the contact pins 8-*i* are gold-plated in each case.

As can be seen in FIG. 2, the plug pin 7 has two spring-loaded locking projections 9A, 9B which are opposite one another and can catch into the locking recesses 3A, 3B in the rail component 2 at locking points. The locking projections 9A, 9B can be countersunk in a housing of the plug pin 7 against the spring power of a respectively associated spring, it being possible to adjust the spring power of the fitted spring according to the assembly specifications. In a possible embodiment, the spring power of the springs is so great that the locking is only initiated at a very high acceleration force which amounts to a multiple of the gravitational acceleration force. In a possible embodiment, the locking is only initiated at an acceleration of more than sixteen times the gravitational acceleration force G.

As can be seen from FIG. 2, it is very easily possible to attach the aircraft cabin module 5 to the attachment device 1. Before the locking procedure, i.e. before the locking projections 9A, 9B catch into corresponding locking recesses 3A, 3B, the aircraft cabin module 5 to be mounted can be moved by the fitter in the longitudinal direction of the rail component 2 to perform a fine adjustment. The direct voltage supply contacts 4-1, 4-2 are connected to a direct voltage supply source for normal operation. The electrical contacts 4-3, 4-4 are connected to a direct voltage source for emergency operation. The data contacts 4-5, 4-6, 4-7, 4-8 are connected to a server for the exchange of data with the respective aircraft cabin modules. The electrical contacts 4-9, 4-10, 4-11 are connected to an alternating voltage source which supplies, for example an alternating voltage with an amplitude of 115 volt.

Figure 3:
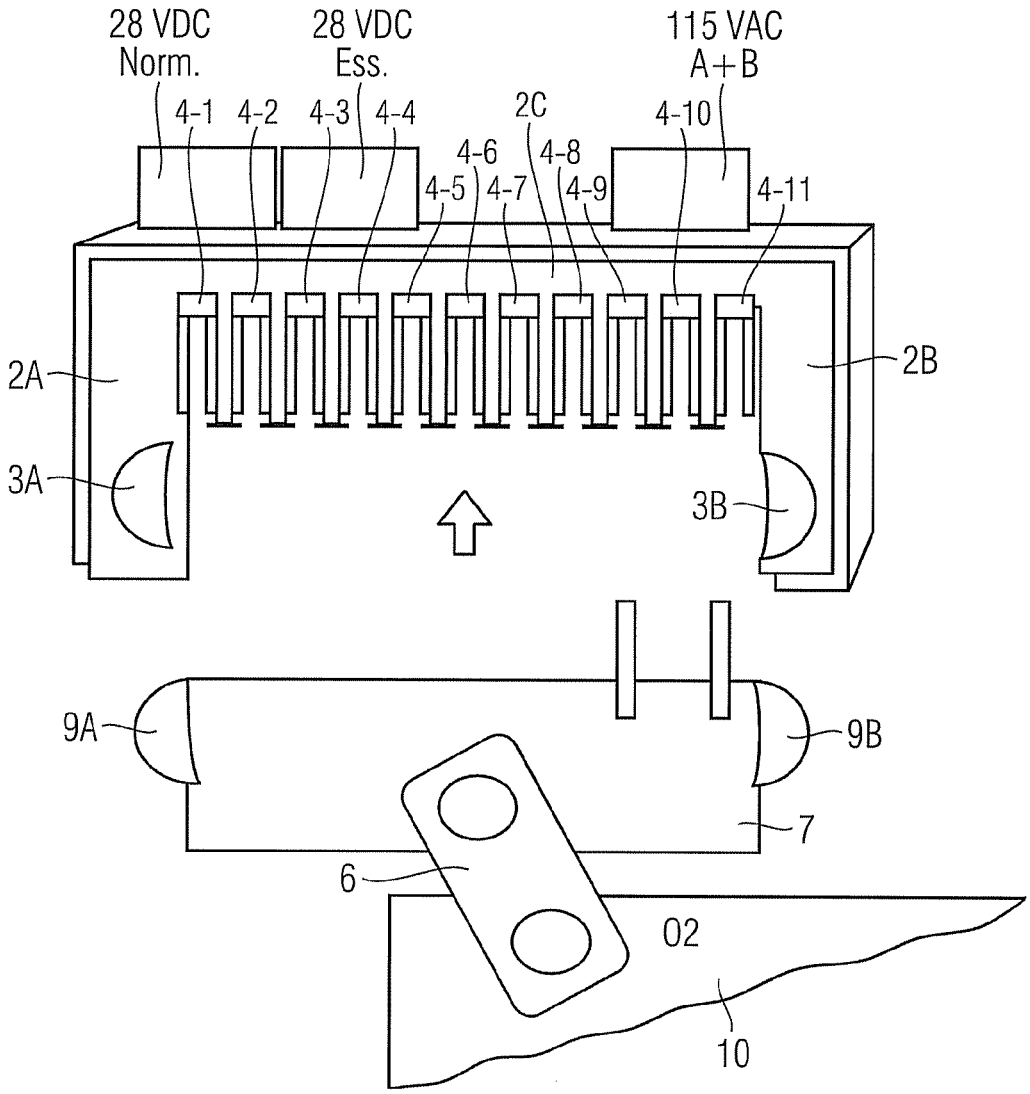
FIG. 3 shows the fitting of an emergency oxygen supply unit to the embodiment, shown in FIG. 1, of the attachment device according to the invention.

FIG. 3 shows the attachment of an emergency oxygen supply unit 10 to the attachment device 1. Like the passenger supply unit 5, the emergency oxygen supply unit 10 has a plug pin 7 which is connected to the emergency oxygen supply unit 10 via a joint 6. The emergency oxygen supply unit 10 is used for the decentralised supply of oxygen, denoted by reference character O2, to the passengers in an emergency, oxygen masks falling out of the emergency oxygen supply unit 10. An alternating voltage of, for example 115 volt AC is required for the voltage supply of the emergency oxygen supply unit 10. For this reason, the electrical plug pin 7, as shown in FIG. 3, has two contact pins 8-9, 8-11 which engage in corresponding electrical contacts 4-9, 4-11 of the rail component 2.

As can be seen from FIGS. 1 to 3, the device 1 is not only used for attaching the aircraft cabin modules, but also for the supply of electrical energy to the modules as well as for the exchange of data between the aircraft cabin modules and a central computer unit, for example a server. The attachment device 1 is suitable for any aircraft cabin modules, for example for passenger supply units, emergency oxygen supply units, cabin illumination units, passenger audio units, passenger video units or air jet units. The attachment device 1 can significantly reduce the complexity in respect of cabling. A separate cabling for the transmission of energy and data is not required. Furthermore, the mounting of the aircraft cabin modules is made considerably easier for the fitter. A substantial improvement is achieved in respect of the flexibility during installation of the aircraft cabin modules. In addition, the maintainability of the aircraft cabin modules is made easier. The use of the attachment device 1 as a standardised interface also makes it possible to integrate new aircraft cabin modules into the system in a rapid and simple manner. Furthermore, the installation of aircraft cabin modules according to the passengers' wishes is simplified.

The invention claimed is:

1. A device for attaching at least one aircraft cabin module, said device comprising:

a component with a center portion and two limbs, the component being configured in U shape as a rail component, the limbs having locking recesses for the releasable locking of spring-loaded locking projections being fitted on a plug pin of an aircraft cabin module and catching into the locking recesses, and the center portion connecting the two limbs; and a plurality of electrical contacts for the voltage supply and for the exchange of data with said aircraft cabin module, the electrical contacts exerting a supporting function for moving the plug pin in a longitudinal direction of the rail component before the locking of the locking projections;

wherein the plurality of electrical contacts comprise a group of direct voltage contacts configured for connecting to a direct voltage supply for supplying a direct voltage, a group of alternating voltage contacts configured for connecting to an alternating voltage supply for supplying an alternating voltage, and a group of data contacts configured for connecting the aircraft cabin module to an aircraft cabin server for exchanging data between the aircraft cabin module and the aircraft cabin server, wherein the data contacts each have a predetermined characteristic impedance which amounts to 100 ohm/meter or corresponds to the characteristic impedance of a data bus used.

2. The device for attaching at least one aircraft cabin module according to claim 1, wherein the electrical contacts are formed by contact grooves in which contact pins of the plug pin fitted to the aircraft cabin module can be moved in a longitudinal direction of the rail component before the locking of the plug pin.

3. The device according to claim 2, wherein the rail component consists of an electrically insulating material in which the electrically conducting contacts are inserted.

4. The device according to claim 3, wherein the electrically insulating material comprises aluminum, CFRP or Teflon.

5. The device according to claim 1, wherein the electrical contacts are each covered with a protective cap to protect against corrosion.

6. The device according to claim 5, wherein the protective cap is a rubber lip.

7. The device according to claim 1, wherein the device is configured to be attached to a passenger supply unit, a compensation unit, an emergency oxygen supply unit, a cabin illumination unit, a passenger audio unit, a passenger video unit or an air jet unit.

* * * * *